US006484458B1

(12) United States Patent
Park

(10) Patent No.: US 6,484,458 B1
(45) Date of Patent: Nov. 26, 2002

(54) METHOD OF AND APPARATUS FOR PREVENTING STRUCTURE FROM COLLAPSING DUE TO EARTHQUAKE

(76) Inventor: Jang-Ho Park, 498, Wallpyeong-Dong, Seo-Ku, Daejeon-City 302-701 (KR)

( * ) Notice: Subject to any disclaimer, the term of this patent is extended or adjusted under 35 U.S.C. 154(b) by 0 days.

(21) Appl. No.: 09/761,918

(22) Filed: Jan. 17, 2001

(51) Int. Cl.[7] ..... E04B 1/98
(52) U.S. Cl. ..... 52/167.4
(58) Field of Search ..... 52/167.5, 167.4, 52/167.7, 167.8

(56) References Cited

U.S. PATENT DOCUMENTS 4,328,648 A * 5/1982 Kalpins ..... 248/638
5,542,220 A * 8/1996 Yoshimura et al. ..... 188/378
5,765,322 A * 6/1998 Kubo et al. ..... 248/634
5,934,029 A * 8/1999 Kawai et al. ..... 52/167.1
6,116,784 A * 9/2000 Brotz ..... 248/566
6,321,492 B1 * 11/2001 Robinson ..... 52/167.1

* cited by examiner

*Primary Examiner*—Carl D. Friedman
*Assistant Examiner*—Steve Varner
(74) *Attorney, Agent, or Firm*—Irving Keschner

(57) ABSTRACT

Method and apparatus for preventing collapse of a structure due to an earthquake by using a construction with a water chamber whose outside contacts a receiving area, provided to the earth's surface, and balance cables each connected to a plurality of weights and variable weights lighter than a predetermined weight. The water chamber is separated from the receiving area and raised form the earth's surface by draining off the water in the water chamber during an earthquake, and returns to its original position by increasing the weight of the water chamber once the earthquake completely stops.

7 Claims, 7 Drawing Sheets

METHOD OF AND APPARATUS FOR PREVENTING STRUCTURE FROM COLLAPSING DUE TO EARTHQUAKE

BACKGROUND OF THE INVENTION

1. Field of the Invention

The present invention generally relates to a method of and an apparatus for preventing a structure from collapsing by earthquake shocks and torsional moment during an earthquake. More particularly, it relates to a method of an apparatus for preventing a structure from being wrecked by making them be raised and separated from the surface of the ground (for example, the present invention is actuated at the 7th degree on the seismic scale in case that the structure is designed to withstand lateral seismic stresses of 8th degree) when there is a great earthquake enough to demolish structures such as houses and multi-storied buildings.

2. Description of the Prior Art

Structures including buildings, bridges, towers, fortresses, etc. are built on the ground from the underground, and they are designed and built strongly enough to withstand external shocks or seismic stresses of a given degree as well as their own load or loads of various things that are placed on them.

However, the conventional structures may be easily wrecked by a very strong earthquake whose intensity is higher than their own resistance against the earthquake. The earthquake is a series of suddenly generated elastic waves in the earth caused by movement of the earth's crust, the structures built perpendicularly on the surface of the ground receive torsional moment when the earthquake shock gets to the surface of the ground. When an earthquake with such a moment exceeding the limit of the earthquake proof architecture, the structures become wrecked.

There are many earthquake zones in the earth, and the areas near these earthquake zones have had a loss of lives and property damage by the collapse of structures due to the occurrence of earthquakes. In order to obviate the above problems, the present inventor developed a method of and an apparatus for preventing collapse of structures due to earthquakes and filed a Korea patent application for this invention (Korean patent application No. 97-22349). According to this application No. 97-22349, a structure is designed to go down to a guard construction, built under the ground, during an earthquake, and cannot provide protection to the structure and lives in the structure against the earthquake.

In the application No. 97-22349, a structure cannot go down to its guard construction until water is supplied to its water chamber when an earthquake is generated. Thus, if the water supply system is damaged by the earthquake, the above invention cannot achieve the object of preventing the collapse of a structure due to an earthquake, and since its weights, provided to the underground guard construction, are directly connected to the structure via balance cables, the earthquake shocks may be delivered to the structure through its balance cables.

SUMMARY OF THE PRESENT INVENTION

Accordingly, the present invention is directed to a method of and an apparatus for preventing the collapse of a structure due to an earthquake that substantially obviate the problems due to limitations and disadvantages of the related art.

It is an object of the present invention to provide a method of and an apparatus for preventing the collapse of a structure due to an earthquake by making the structure be moved up and separated from the surface of the ground not to receive torsional moment when there is a great earthquake of a given intensity.

It is another object of the present invention to provide a method of and an apparatus for preventing the collapse of a structure via earthquake-proof means not to deliver earthquake shocks to the structure through the balance cables connected to weights.

It is still another object of the present invention to provide a method of and an apparatus for obviating the collapse of a structure due to an earthquake and for precluding loss of lives and property damage.

In order to obtain the above-mentioned objects of the present invention, there is disclosed a method of preventing collapse of a structure due to an earthquake by using a construction with a water chamber whose outside contacts a receiving area, provided to the earth's surface, and balance cables each connected to a plurality of weights and variable weights a little lighter than the total weight of the structure's own weight, variable weight of things and people within the structure, and the weight of the water in the water chamber. The structure with the water chamber is separated from the receiving area and raised form the earth's surface by draining off the water in the water chamber during an earthquake, and returns to its original position by increasing the weight of the water chamber once the earthquake completely stops.

According to another aspect of the present invention, an apparatus for preventing collapse due to an earthquake, includes a receiving area provided to the earth's surface where a structure is to be built; a plurality of balancing chambers equidistantly provided on all sides of the receiving area; a water chamber built under the structure and having an outside closely contacting the receiving area; a balance weight provided to the bottom of the water chamber and serving as a center of gravity; sand provided around the balance weight to distribute vibrations; and an earthquake-proof means installed on the upper part of the water chamber in order to prevent seismic waves from being delivered to the structure through balance cables.

DESCRIPTION OF THE INVENTION

Reference will now be made in detail to the preferred embodiments of the present invention, examples of which are illustrated in the accompanying drawings.

Figure 1:
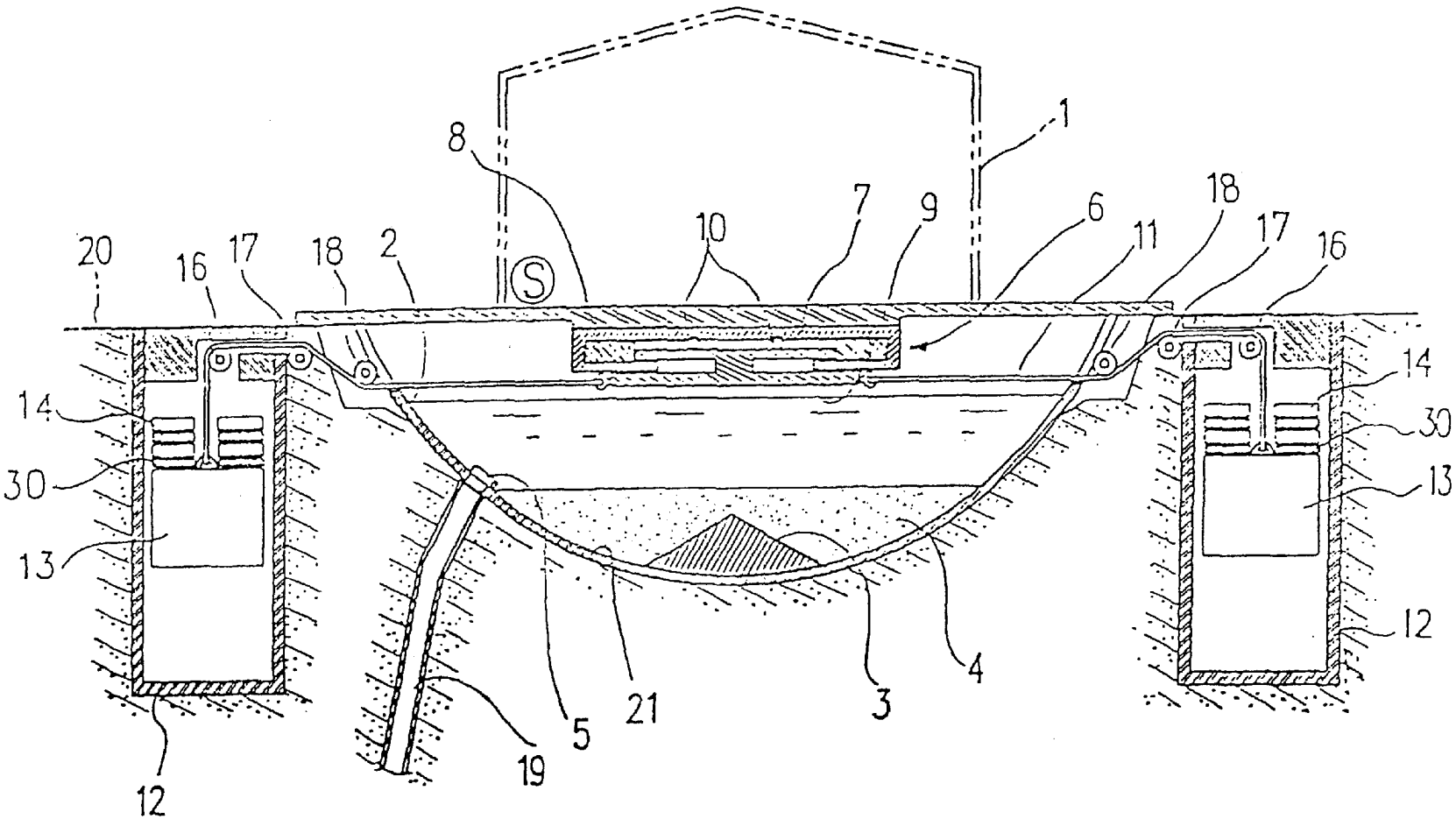
FIG. 1 is a longitudinal sectional view of a structure in a normal state in accordance with the present invention.
Figure 2:
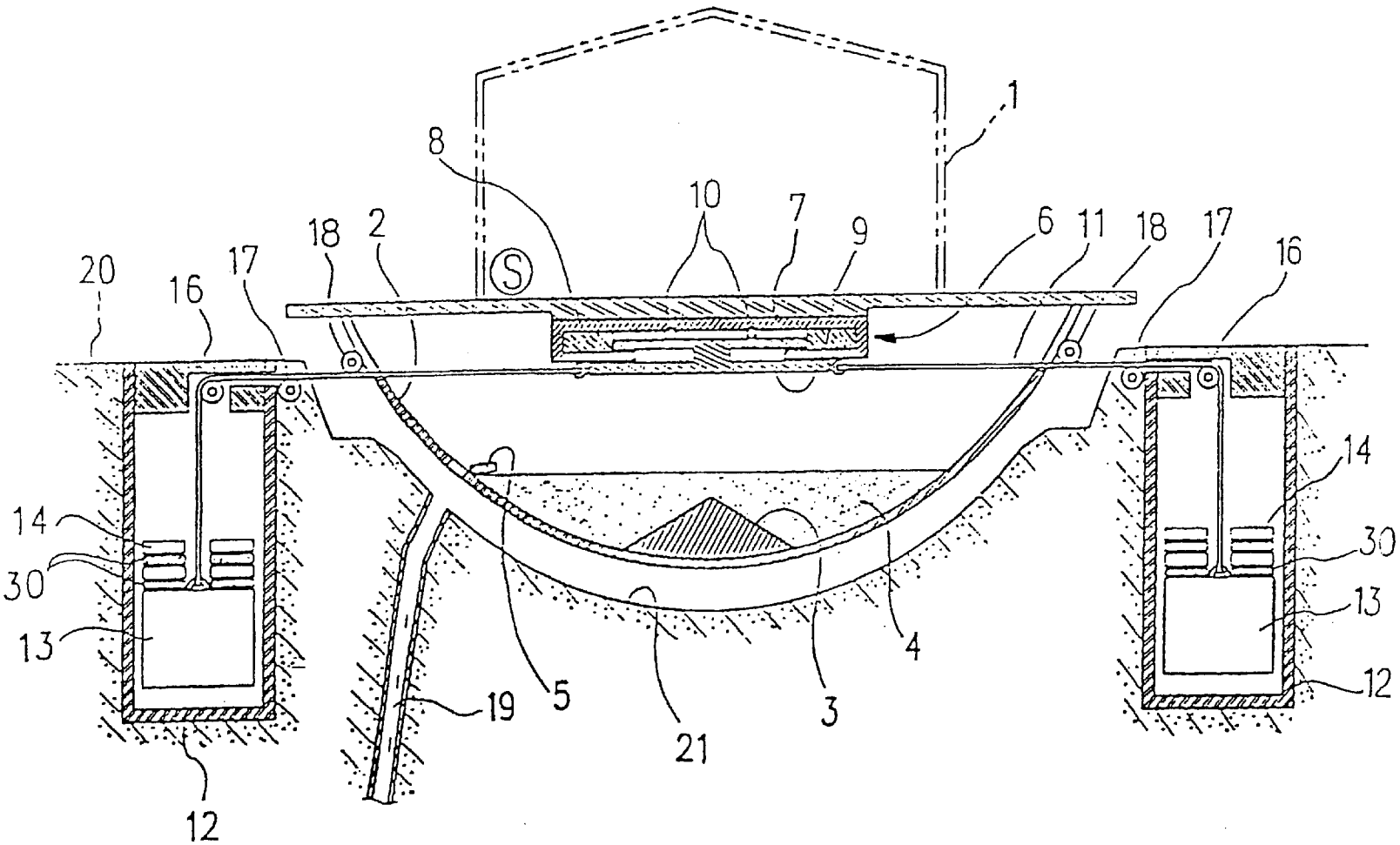
FIG. 2 is a longitudinal sectional view of the structure during an earthquake in accordance with the present invention.
Figure 3:
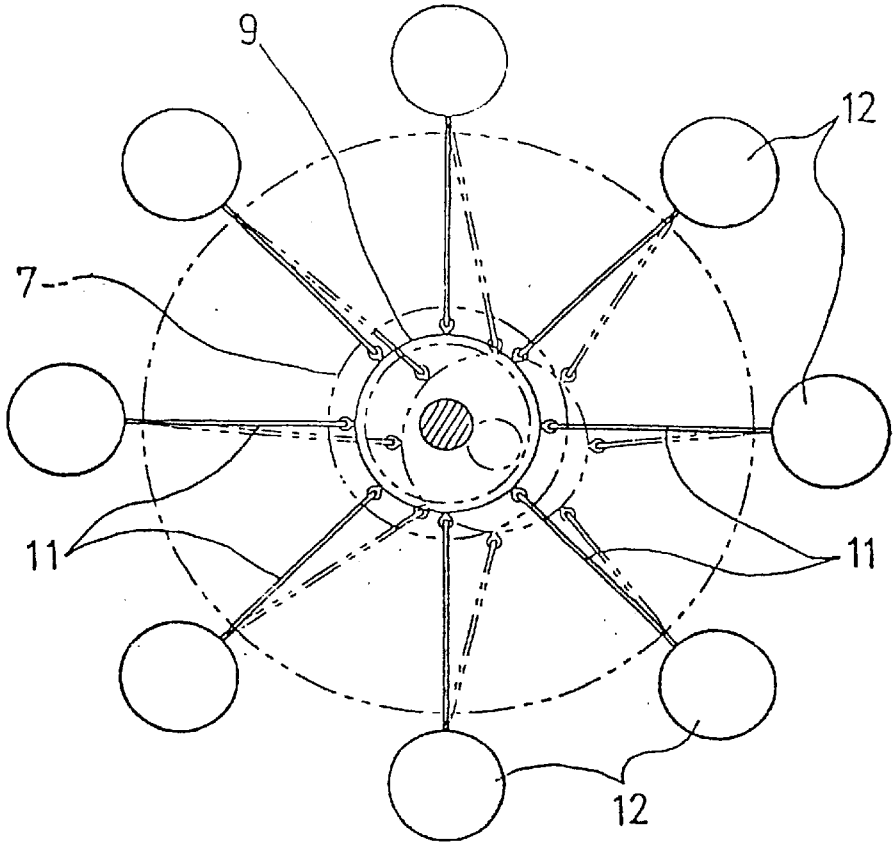
FIG. 3 is a plan view showing the operation of an earthquake proof means in accordance with the present invention.
Figure 4:
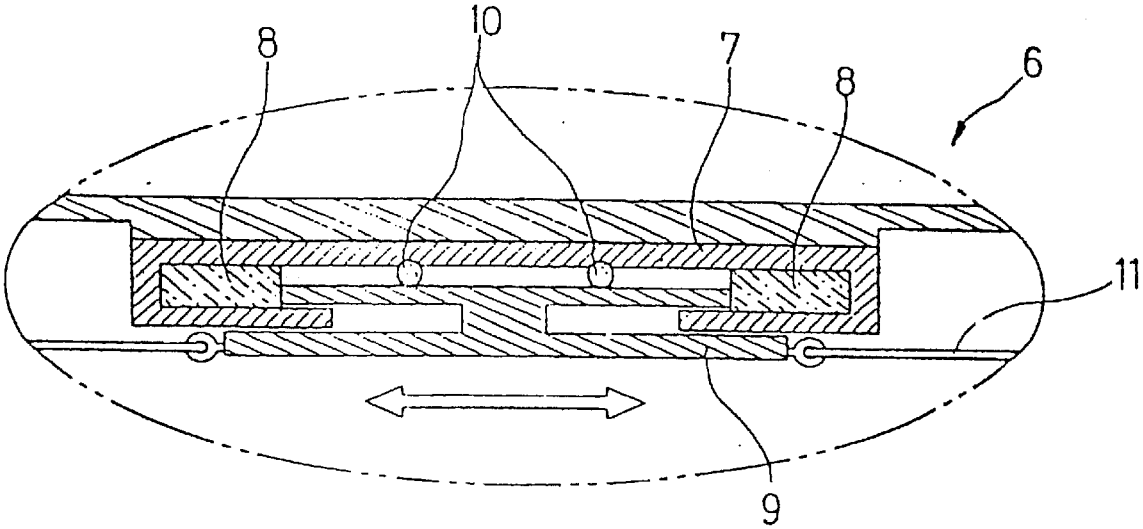
FIG. 4 is an enlarged longitudinal sectional view of the earthquake-proof means in accordance with the present invention.

Referring to FIG. 1, a receiving area 21 is provided to a place where a structure 1 is to be built, and a plurality of balancing chambers 12 are equidistantly provided to all sides of the receiving area 21. A water chamber 2 is placed in the receiving area 21 under the structure 1. The water chamber 2 has a balance weight 3 and sand 4 on its bottom to distribute vibrations thereby keeping the structure 1 balancing, and an earthquake-proof means 6 is provided over the water chamber 2 to prevent earthquake shocks from being delivered to the structure 1 through balance cables 11.

Figure 5:
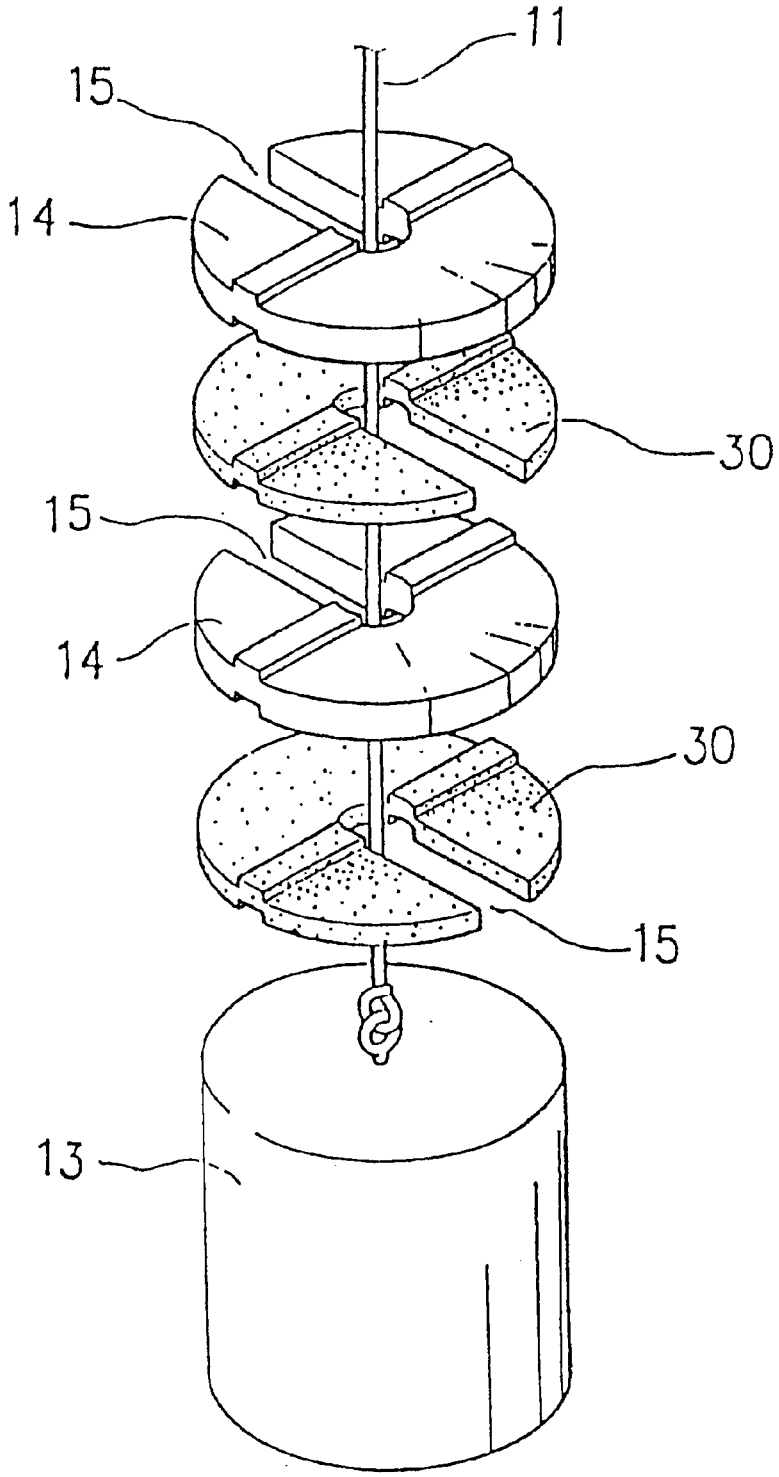
FIG. 5 is an exploded perspective view of weights and variable weights in accordance with the present invention.

The respective balancing chambers 21 have a weight 13, and this weight 13 is designed to be a little lighter than the total weight including the structure 1's own weight, variable weight of the structure's interior, and the water weight of the water chamber 2. The earthquake-proof means 6 and the weights 13 are connected to each other via the balance cables 11, and a variable weight 14 with an opening part 15 (refer to FIG. 5) may be additionally provided over the respective weights 13 in proportion to the weight of the structure 1. The balance cables 1 connecting the weights 13 to the earthquake-proof means 6 are guided by a plurality of rollers 16, 17, and 18. The earthquake-proof means 6 is constructed by connecting a fixed member 7, immovably mounted on the water chamber 2, and a sliding member 9 to each other, and bearings are interposed between the sliding member 9 and the fixed member 7.

Cushion members 8 are provided to the fixed member 7's inside, and the balance cables 11 are connected to the sliding member 9 so that the sliding member 9 absorbs seismic waves delivered through the balance cables 11. Since the weight of the weights 13 and variable weights 14 is designed to be a little lighter than the total weight of the structure 1's own weight, the variable weight of people or furniture in the structure 1, and that of the water in the water chamber 2, the outside of the water chamber 2 comes in close contact with the receiving area 21's inside.

Thus, the structure 1 can be stably utilized in the normal state that means there is not an earthquake. If there occurs a very strong earthquake whose intensity exceeds a given degree of earthquake strength, a sensor provided to one side of the structure 1 monitors the seismic waves to let a valve 5, provided to one side of the water chamber 2, open. Accordingly, the water in the water chamber 2 flows out through the opened valve 5 and a waterway 19.

As the water in the water chamber 2 flows out, the weight of the structure 1 and water chamber 2 is reduced to be lighter than that of the weights 13 and variable weights 14 in the balancing chamber 12, and the weights 13 and the variable weights 14 go down to pull the balance cables 11 so the structure 1 and the water chamber 2 are raised from the receiving area 12 and separated from the earth's surface 20. The structure 1 and the water chamber 2, separated from the receiving area 21 and suspended, become totally isolated from the seismic waves, thus preventing the collapse of the structure and loss of lives. The structure 1, suspended on the pulled balance cables 11, comes to be raised perpendicularly since the balance cables 11 are pulled by the loads of the weights 13 and variable weights 14 in the balancing chambers 12 equidistantly installed on all sides of the structure 1. In addition, the balance weight 3 made on a weighty material such as lead, is fixed on the bottom center of the water chamber 2 under the structure 1, and the sand 4 is held in the water chamber 2, thus keeping the balance of the structure 1 separated from the receiving area 21 and being suspended.

Particularly, according to the present invention, the balance cables 11, connected to the weights 13 are the variable weights 14, are directly connected to the structure 1 via the earthquake-proof means 6. Therefore, if the seismic waves are transmitted to the structure 1 through the balancing chambers 12 and balance cables 11 while the structure 1 is being suspended, only the sliding member 9 of the earthquake-proof means 6, connected with the balance cables 11, is moved from side to side and absorbs the earthquake shocks, thus providing protection to the structure 1 from the earthquake.

Since the sliding member 9 of the earthquake-proof means 9 is not only connected to the fixed member 7 by the bearings 10 but also supported by the cushion members 8 inside of the fixed member 7, only the sliding member 9 is moved even though the earthquake shocks are delivered through the balance cables 11, while keeping the fixed member 7 fixed along with the structure 1.

It is preferable that the balance cables 11, connecting the weights 13 to the structure 1, are guided by a plurality of the rollers 16, 17 and 18. Any material that can effectively absorb shocks, including rubber or gel, can be used as the cushion members 8, provided to the inside of the fixed member 7.

In the meantime, if the earthquake completely stops while the structure 1 is being suspended, the valve 5 is closed and the water is supplied to the water chamber 2 again to make the structure 1 and the water chamber 2 be heavier than the weights 13 and the variable weights 14. Accordingly, the structure 1 goes down to make the water chamber 2 closely contact the receiving area 21's inside so the structure 1 can be stably used. A given amount of water remains in the water chamber 21 even in the normal state, and the water chamber 21 may be sued as an indoor swimming pool.

Cushion plates 30 are interposed between the weights 13 and the variable weights 14 going up and down according to a situation, thus preventing noises that may be produced when the weights 13 and the variable weights 14 are working.

Figure 6:
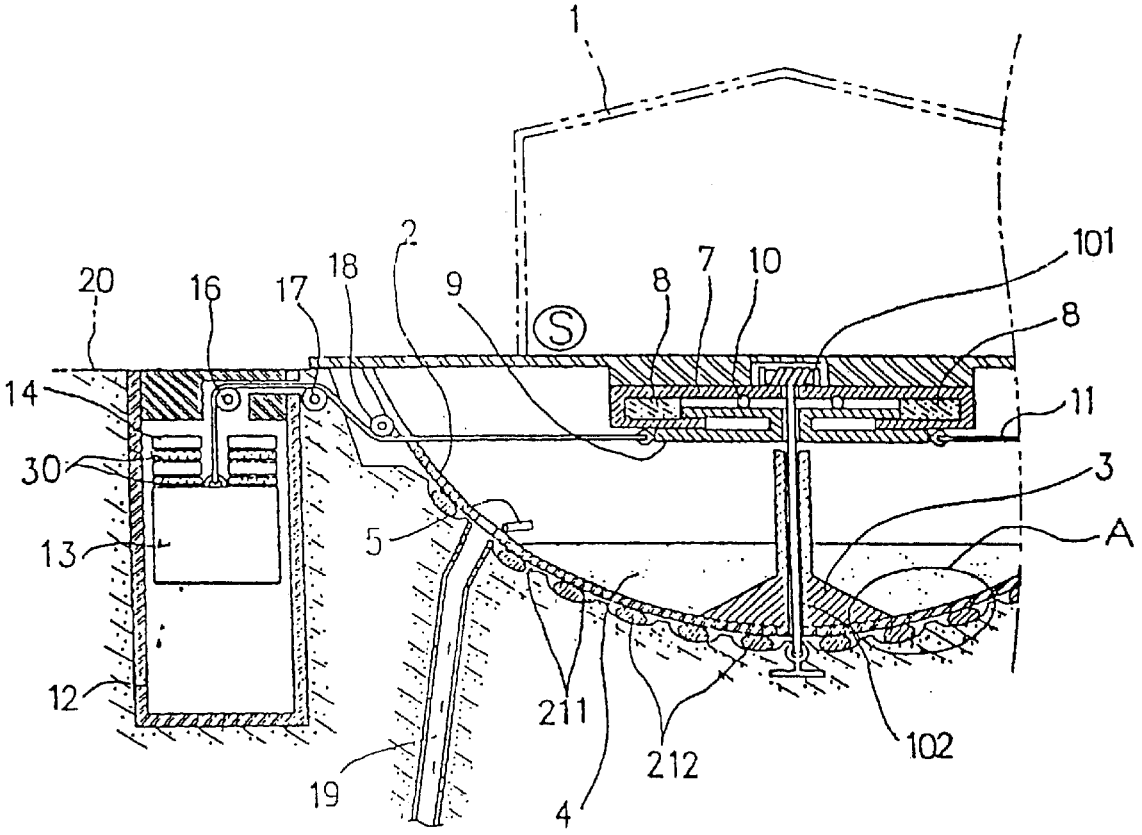
FIG. 6 is a longitudinal sectional view of a structure in the normal state in accordance with another preferred embodiment of the present invention.
Figure 7:
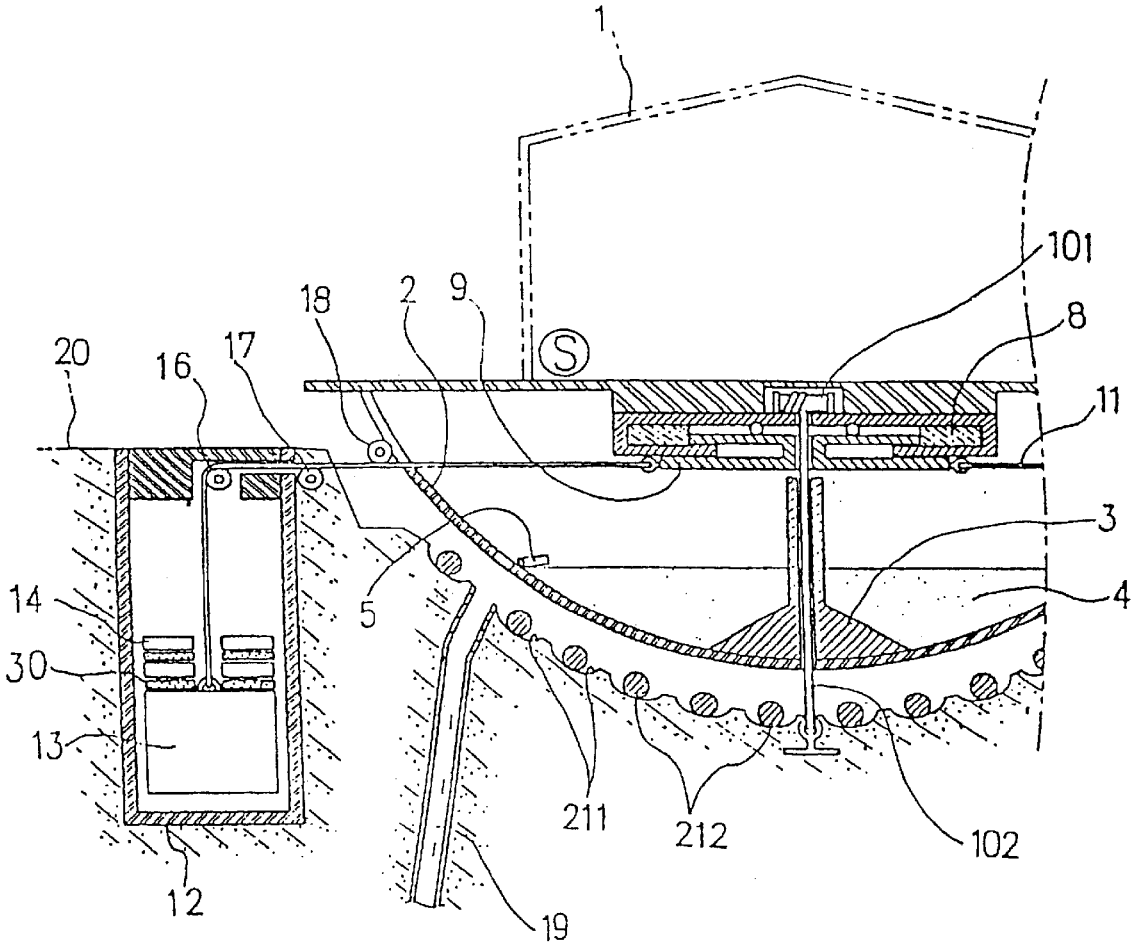
FIG. 7 is a longitudinal section view of the structure during an earthquake in accordance with another preferred embodiment of the present invention.
Figure 8:
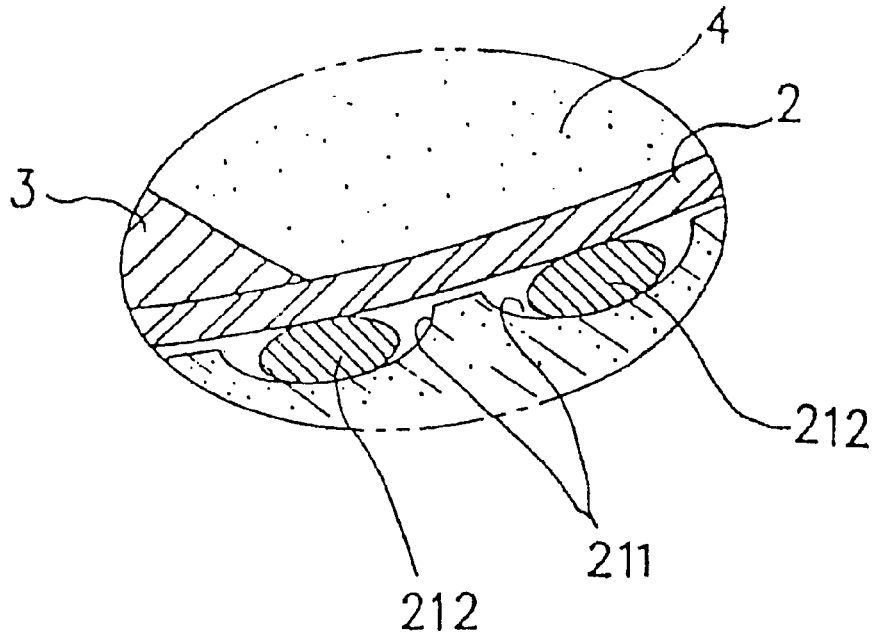
FIG. 8 is an enlarged sectional view of the part "A" in FIG. 6.

FIGS. 6 to 8 each depict longitudinal sectional views in accordance with another preferred embodiment of the present invention.

The receiving area 21 of the ground's surface 20 has a plurality of receiving races 211 which are respectively filled with a shock-absorbing member. The shock absorbing member is provided in order to lower the shocks that may occur when the structure 1, separated from the receiving area 21 during an earthquake, is descended, and it is preferable that a resilient shock-absorbing ball 212 is used as the shock absorbing member.

The structure 1 should be separated from the shock-absorbing balls 212 when rising. As the structure 1 and the shock-absorbing balls 212 are totally separated from each other during the earthquake, the transmission of the seismic waves to the structure 1 through the shock-absorbing balls 212 can be prevented. A cable 102 is would about a roller 101, provided to the bottom center of the structure 1, and has one end fixed to the receiving area 21's center through the middle of the earthquake-proof means 6 and balance weight 3. The roller 101 can be turned by a rotating force-generating means such as an electric motor, and is locked by a ratchet means after is has completed its operation.

The cable 102 always guides the structure 1 that is moved or not moved in response to the state of the roller 101, to the middle of the receiving area 21. If there occurs an earthquake whose intensity exceeds a given degree of earthquake strength, the roller 101 is turned to loose, simultaneously with draining off the water in the water chamber 2, and the cable 102 sufficiently comes loose, thus making the structure 1 be raised smoothly.

As the earthquake completely stops, the structure 1 is correctly settled in the middle of the receiving area 21 by turning the roller 101 in the direction of winding before the water is supplied to the water chamber 2, and the water is then provided thereto, thereby preventing the structure 1 from leaning to one side.

In the normal state when the water chamber 2 is used as an indoor swimming pool, even if the water in the water chamber 2 drains off to replace with clean water, the rise of the structure 1 can be prevented by keeping the roller 101 locked, thus keeping the water in the water chamber 2 clean all the time. The water in the water chamber 2 can be also kept clean by a water purifying system.

Figure 9:
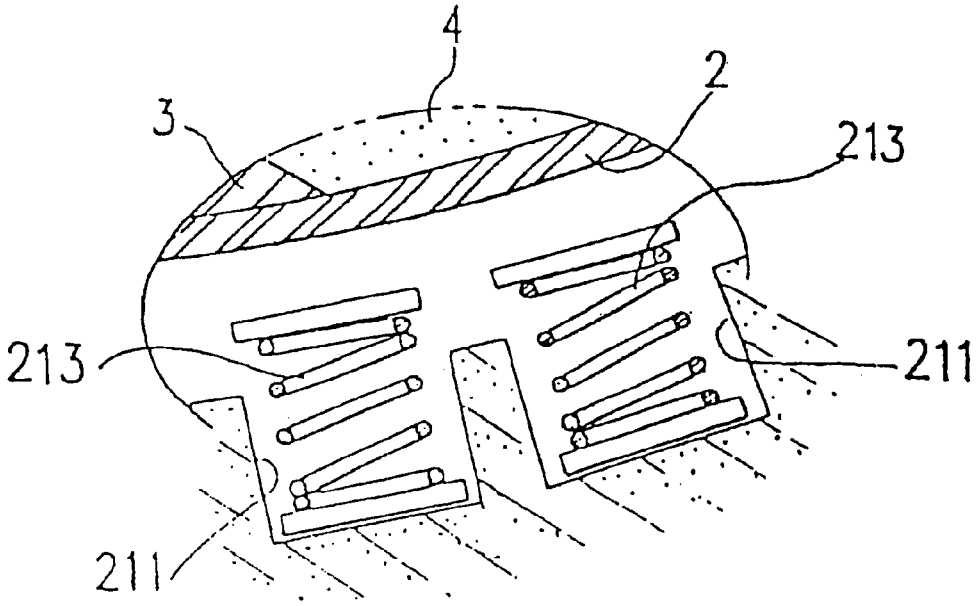
FIG. 9 is a longitudinal sectional view of another shock-absorbing member replacing the shock-absorbing member in FIGS. 6 to 8 in accordance with another preferred embodiment of the present invention.

FIG. 9 is a longitudinal sectional view of another shock-absorbing member replacing the shock-absorbing member in FIGS. 6 to 8 in accordance with another preferred embodiment of the present invention. Instead of the shock-absorbing member for reducing the shocks acting on the water chamber 2, a spring 213 having a repulsive force against compression may be used. The same shock absorbing effect can be achieved by inserting the spring 213 into each receiving race 211.

As described above, in the inventive construction having the water chamber stably seated in the receiving area, the balance cables are connected to a plurality of weights and variable weights that are a little lighter than the total weight of the structure's own weight, variable weight of things and people in the structure, and the weight of the water in the water chamber, so the structure with the water chamber can be separated from the receiving area and rise from the surface of the ground by draining off the water in the water chamber during an earthquake.

Once the earthquake completely stops, the structure returns to its original position by increasing the weight of the water chamber. Therefore, if there occurs and earthquake whose intensity exceeds a certain level of earthquake strength, the present invention makes the structure be separated from the earth's surface, thus preventing earthquake shocks from being delivered to the structure and wrecking it, and avoiding a loss of lives and property damage.

What is claimed is:

1. An apparatus for preventing collapse of a structure due to an earthquake, comprising:

a receiving area provided to the earth's surface where a structure is to be built;

a plurality of balancing chambers equidistantly provided on all sides of the receiving area;

a water chamber built under the structure and having an outside closely contacting the receiving area;

a balance weight provided to the bottom of the water chamber and serving as a center of gravity;

sand provided around the balance weight to distribute vibrations; and an earthquake-proof means installed on the upper part of the water chamber in order to prevent seismic waves from being delivered to the structure through balance cables.

2. An apparatus according to claim 1, wherein the earthquake-proof means is constructed by connecting a fixed member, immovably mounted on the water chamber, to a sliding member, bearings are interposed between the sliding member and the fixed member whose inside is filled with a cushion member, and the balance cables are connected to the sliding member's lower portion so that the sliding member absorbs the seismic waves delivered through the balance cables.

3. An apparatus according to claim 1, wherein each balancing chamber has a weight that is designed to be a little lighter than the total weight including the structure's own weight, variable weight of the structure's interior, and the water weight of the water chamber, and the earthquake-proof means and the weights are connected to each other via the balance cables, and a variable weight with an opening part can be additionally provided over the respective weights in proportion to the weight of the structure while the balance cables, connecting the weights to the earthquake-proof means, are guided by a plurality of rollers.

4. An apparatus according to claim 1, wherein the receiving area provided to the earth's surface has a plurality of receiving races, and each receiving race is filled with a shock-absorbing member that can reduce shocks acting on the structure going down.

5. An apparatus according to claim 1, wherein a roller is provided to the bottom center of the structure, and a cable wound about the roller has one end, fixed on the center of the receiving area through the middle of the earthquake-proof means and the balance weight so that the suspended structure can be correctly seated in the middle of the receiving area.

6. An apparatus according to claim 4, wherein a shock-absorbing ball with an elastic force is used as the shock-absorbing member.

7. An apparatus according to claim 4, wherein a spring with a repulsive force against compression is used as the shock-absorbing member.

* * * * *